US006461489B1

(12) United States Patent
Choi

(10) Patent No.: US 6,461,489 B1
(45) Date of Patent: Oct. 8, 2002

(54) CATHODE PLATE FOR ELECTRO WINNING AND REFINING

(75) Inventor: Chang-Young Choi, Kangnam-Ku (KR)

(73) Assignee: Korea Zinc. Co., Ltd., Gangnam-Ku-Seoul (KR)

( * ) Notice: Subject to any disclaimer, the term of this patent is extended or adjusted under 35 U.S.C. 154(b) by 0 days.

(21) Appl. No.: 09/685,628

(22) Filed: Oct. 9, 2000

(51) Int. Cl.[7] ..... C25B 11/00

(52) U.S. Cl. ..... 204/280; 204/281; 204/286.1; 204/278.5

(58) Field of Search ..... 204/280, 281, 204/279, 286.1, 278.5

(56) References Cited

U.S. PATENT DOCUMENTS 4,447,307 A * 5/1984 Davis et al. ..... 204/279

5,492,609 A * 2/1996 Assenmacher ..... 204/286.1

* cited by examiner

*Primary Examiner*—Bruce F. Bell
(74) *Attorney, Agent, or Firm*—Harness, Dickey & Pierce P.L.C.

(57) ABSTRACT

A cathode plate particularly adapted for zinc and copper electro-winning and refining includes a panel of aluminum having a top and two opposed side edges, a sloped plastic shield along the top and plastic ribbons along the side. A head bar with two hooks is welded on the top of the plate. The top plastic molding and the side edge ribbons are manufactured simultaneously by a specially devised injection machine. When the cathode plates are immersed into the electrolyte, the top plastic shield keeps the zinc deposit level uniform and prevents the top portion and the liquid contact area of cathode plates from corrosion by acid mist generated during electrochemical reactions. The sloped lower part of top plastic shield facilitates inserting a stripping knife between the zinc deposit and the cathode plate.

9 Claims, 2 Drawing Sheets

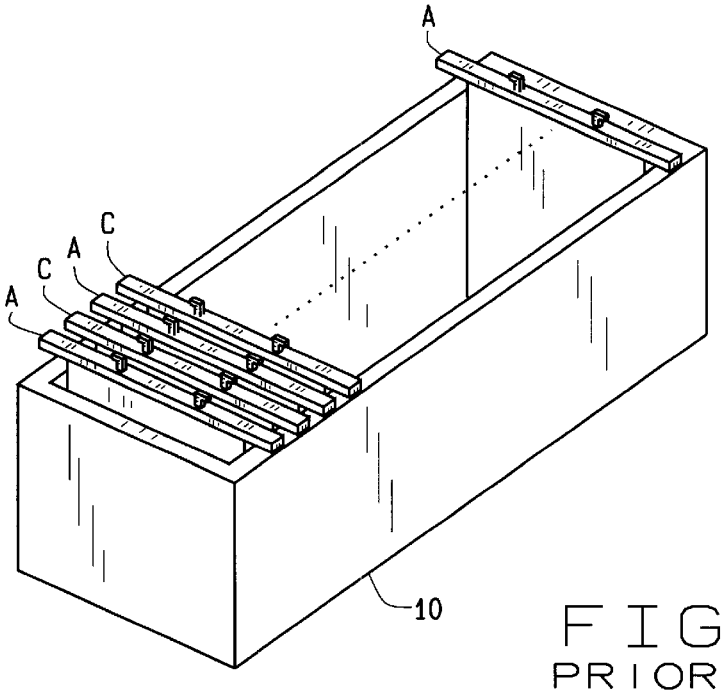
FIG. 1
PRIOR ART
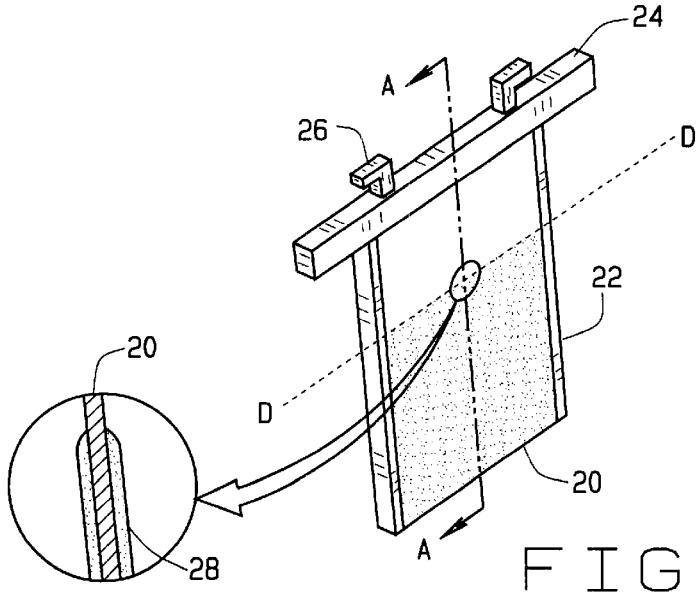
FIG. 2
PRIOR ART
FIG. 2A
PRIOR ART

CATHODE PLATE FOR ELECTRO WINNING AND REFINING

BACKGROUND OF THE INVENTION

This invention relates to improvements in cathode plates for electro-winning and refining, and in particular to cathode plates for electro-winning and refining zinc, copper, and other metals from solutions by an electrolysis process.

Electrolysis is performed by passing an electric current through an electrolyte, causing migration of positively charged ions to the negative electrode (cathode) and the negatively charged ions to the positive electrode (anode). High purity metals such as zinc and copper can be obtained by electrolysis processes.

As shown in FIGS. 1 and 2, the electro-winning and refining electrolysis is performed in an electrochemical cell 10. The cell consists of anode and cathode plates immersed in an electrolyte solution and an external circuit that permits the flow of electrons from the anode to the cathode.

A cathode (the negative electrode) and the anode (the positive electrode) are immersed in the electrolyte solution, and a direct current (DC) source is connected to the electrodes. This causes both a reduction reaction and an oxidation reaction to occur. Positives ions (such as Zn++ and Cu++) migrate to the negative electrode and are deposited onto the cathode surface in the form of a pure metal sheet (the reduction reaction). Negative ions migrate to the positive electrode and give up an electron and result in generating of gas such as oxygen (oxidation reaction).

It is essential that the electrolyte should be a chemical compound that is dissociated or ionized in an acid solution such as $ZnSO_4$ or $CuSO_4$ containing the metal to be recovered, and be conductive to the electric current.

Once the metal is deposited on the cathode plate by electrolysis, the metal-deposited cathode is transferred to a stripping area by crane. A stripping machine needs stripping knives to initiate the stripping of the recovered metal from the cathode plate. The knives first separate the deposited metal from the plate at the upper boundary of the deposit, and work their way down to the bottom of the deposited metal on the cathode plate to complete the stripping. As shown in FIG. 2, the cathode plate comprises a sheet of aluminum (Al), a head bar 24 welded to the aluminum plate for current transmission to the plate, and two hooks 26 for transferring the plate.

Stripping can be difficult, because the deposited metal is strongly attached at the side edges of the catheters. Recently, plastic ribbons have been placed on the side edges of cathode plates to facilitate stripping. The ribbons secure the space between the deposited metal and the side edges of the cathode plate, promoting easier stripping.

Because the electrolyte level varies during the process, the upper edge of the metal deposited on the cathode plates forms an acute angle along line D—D in FIG. 2, and shown clearly in FIG. 2*a*. The irregular top edge of the deposited metal sometimes causes the stripping knives to slip on the top of the metal deposit, requiring that relatively high pressure be applied to the stripping knives that can damage the surface of the aluminum cathode plate.

The stripping process is preferably automated, so the stripping process must proceed smoothly or there will be a reduction in productivity and an increase in manpower.

SUMMARY OF THE INVENTION

The present invention relates to an improvement in the construction of cathode plates, to facilitate the stripping of deposited metal. Generally, the cathode plate of the present invention comprises an aluminum sheet or panel, having a header bar, and two hooks. A plastic shield is formed on the upper portion of the cathode plate, just below the head bar, and plastic ribbons are formed along the side edges of the sheet. This plastic has a specified thickness, and the lower edge of the plastic shield slopes toward the surface of the sheet at a specified angle.

BRIEF DESCRIPTION OF THE DRAWINGS

FIG. 1 is perspective view of a plurality of cathodes installed in an electrolysis cell;

FIG. 2 is a perspective view of a prior art cathode plate;

FIG. 2*a* is an enlarged partial vertical cross-sectional view of the cathode plate, taken along the plane of line 2*a*—2*a* in FIG. 2;

Corresponding reference numerals indicate corresponding parts throughout the several views of the drawings.

DETAILED DESCRIPTION OF THE PREFERRED EMBODIMENT

Figure 3:
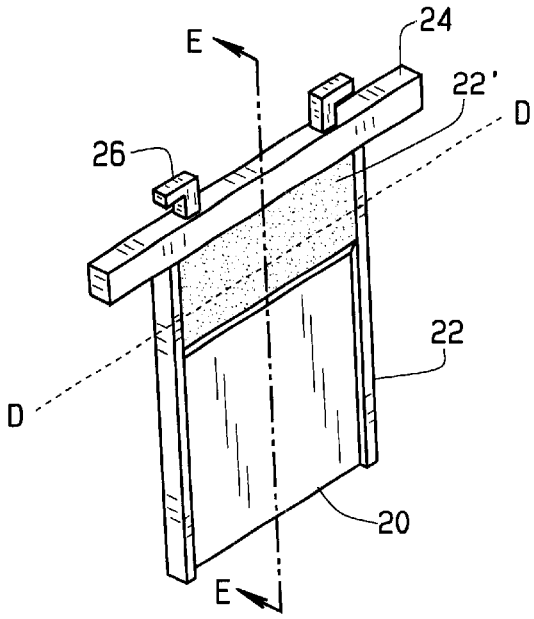
FIG. 3 is a perspective view of a cathode plate constructed according to the principles of the present invention.

A cathode plate 20 constructed according to the principles of this invention is indicated generally as 20 in FIG. 3. The cathode plate 20 comprises a rectangular (and preferably square) plate of aluminum, having a top, a bottom, and left and right sides. A head bar 24 is welded on the top of the cathode plate 20. The head bar 24 ensures that the cathode plate is hung in the electrolysis cell and immersed to the proper depth in the electrolyte, and the bar transmits electric current to the cathode plate 20. Hooks 26 on the upper portion of the cathode plate 20 facilitate transportation and handling of the cathode plate 20.

Both of the side edges of the cathode plate 20 have a plastic ribbon 22 formed thereon of a specified thickness, forming an insulating layer. The upper portion of the cathode plate 20 has a shield 22' formed thereon. It is preferred that the ribbon 22 and the shield 22' be formed in one unitized body, for example by injection molding. The ribbons 22 and the shield 22' are preferably made from polyethylene or polypropylene, or other suitable polymeric material. Thus the cathode plate 20 can be formed in a single injection molding process.

Of course, the ribbons 22 and the shield 22' can be made separately, and different materials and different manufacturing methods (for example spraying) can be used without departing from this invention.

The lower edge of the shield 22' has to extend sufficiently below the line D—D representing the level of electrolyte in the cell, so that the boundary between the lower edge of the shield and the surface of the plate is below the level of the electrolyte, despite fluctuations in the electrolyte level and any turbulence at the surface. This ensures that metal deposit 28 at the boundary is thicker and more uniform.

Figure 4:
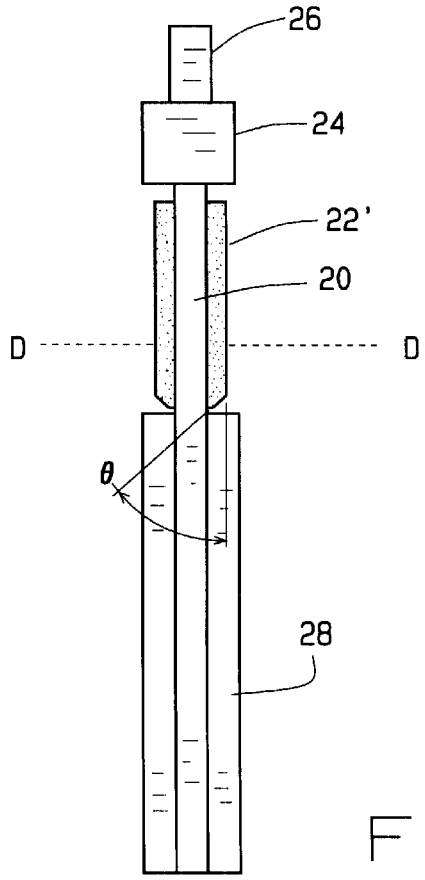
FIG. 4 is a vertical cross-sectional view taken along the plane of line 4—4 in FIG. 3.

As shown in FIG. 4, the lower edge of the shield 22' on each side of the cathode plate 20 is preferably formed with a specified angle $\phi$ that facilitates stripping deposited metal from the cathode plate. This angle $\phi$ is selected to allow the stripping knives to be inserted smoothly between the deposited metal and the surface of the cathode plate 20.

OPERATION

In operation, the cathode plates 20 and anode plates are arranged in alternating fashion in an electrolytic cell, filled with an electrolyte such as $ZnSO_4$ or $CuSO_4$, and a DC current is applied to cause metal, such as Zn (in the case of $ZnSO_4$) or Cu (in the case of $CuSO_4$) to deposit on the surface of the cathode. Because the lower boundary of the shield is consistently below the surface of the electrolyte, the upper edge of the deposited metal is thicker and more uniform than the upper edge of metal deposited on a conventional cathode plate. Moreover, the upper edge of the metal deposited on the cathode 20 forms a greater angle than the acute edge formed on prior art cathode plates. This greater angle facilitates the insertion of a stripping knife between the deposited metal and cathode plate 20.

What is claimed:

1. An improved cathode plate comprising a metal plate adapted to be suspended in an electrolytic cell containing an electrolyte, the improvement comprising a plastic shield on the upper portion of the plate, the lower edge of the shield positioned to be below the surface of the electrolyte when the cathode plate is in the electrolytic cell.

2. The improved cathode plate according to claim 1 further wherein the plate has first and second side edges, and further comprising plastic ribbons along each side edge.

3. The improved cathode plate according to claim 1 wherein the plastic shield and the ribbons are one piece.

4. The improved cathode plate according to claim 1 wherein the plastic shield and the ribbons are made in one piece by injection molding.

5. A cathode plate, mounted in an electrolytic cell, such that the lower portion is immersed in an electrolyte, in combination with a plastic shield formed on the upper portion of the cathode plate, wherein the lower edge of the plastic shield is positioned below the surface of the electrolyte.

6. The cathode plate according to claim 5 wherein the cathode plate has side edges, and further comprising plastic ribbons on the side edges of the plate.

7. The cathode plate according to claim 6 wherein the shield and the ribbons are one piece.

8. The cathode plate according to claim 7 wherein the shield and the ribbons are injection molded.

9. An improved method of electro-winning metal on a cathode plate in an electrolytic bath, the method comprising providing a cathode plate with a plastic shield on its upper portion, extending below the surface of the electrolytic bath so that upper edge of the metal deposited on the cathode plate is below the surface of the electrolytic bath.

* * * * *